United States Patent [19]

Berner

[11] 4,329,792

[45] May 18, 1982

[54] SNOW REMOVER

[75] Inventor: John M. Berner, Minneapolis, Minn.

[73] Assignee: David H. Garven, Bloomington, Minn. ; a part interest

[21] Appl. No.: 123,934

[22] Filed: Feb. 25, 1980

[51] Int. Cl.[3] ..... E01H 5/00

[52] U.S. Cl. ..... 37/43 D; 37/53

[58] Field of Search ..... 37/43 R, 43 B, 43 C, 37/43 D, 43 E, 43 F–43 K, 43 L, 53, 12, 20, 24

[56] References Cited

U.S. PATENT DOCUMENTS

| | | | |
|---|---|---|---|
| 1,844,706 | 2/1932 | Wandscheer | 37/43 C |
| 2,188,800 | 1/1940 | Williamson | 37/43 H |
| 2,508,829 | 5/1950 | Lamy | 37/43 D |
| 2,679,703 | 6/1954 | Borel | 37/43 B X |
| 3,200,519 | 8/1965 | Kennedy | 37/43 R |
| 3,267,594 | 8/1966 | Mattson et al. | 37/53 X |
| 3,468,041 | 9/1969 | Mattson et al. | 37/43 E |
| 3,488,869 | 1/1970 | Heth et al. | 37/43 R |
| 3,512,279 | 5/1970 | Benson | 37/43 R |
| 4,123,857 | 11/1978 | Enters et al. | 37/43 E |
| 4,150,501 | 4/1979 | Hayashi | 37/43 B |

FOREIGN PATENT DOCUMENTS

| | | | |
|---|---|---|---|
| 278894 | 2/1970 | Austria | 37/43 C |
| 143832 | 4/1961 | U.S.S.R. | 37/43 D |

*Primary Examiner*—E. H. Eickholt
*Attorney, Agent, or Firm*—Thomas A. Lennon

[57] ABSTRACT

The invention relates to a very light weight portable single stage snow remover which is electrically powered, can be operated and manipulated in a sideways swinging fashion in the manner of a broom, can handle normally difficult areas to clean such as steps and patios, can conveniently and easily be used in larger areas such as driveways and sidewalks, and can be pushed forward along the surface to be cleaned without having to swing the unit when forward movement is more desirable than sideward movement. The snow remover comprises a bladed rotor which operates within a housing and is rotated by an electric motor, the blades of the rotor throwing the snow rearwardly and upwardly against a snow collecting and directing wall which projects the snow in the direction desired. There is a direct drive relationship between the rotor and the motor and the entire motor-rotor housing is connected with a handle which is selectively adjustable relative to the direction of throw of the rotor and provided with a pair of hand grips to enable the unit to either be swung sideways in the manner of a conventional broom or pushed forward along the surface to be cleaned.

12 Claims, 10 Drawing Figures

SNOW REMOVER

There has long been a need for a small lightweight inexpensive snow remover, which need is progressively increasing because of our increasing urban population and our increasing numbers of people who live in townhouses and condominiums. The public has long had available to it the heavy duty two stage snow throwers in which an auger is driven by a gasoline engine, the auger feeding the snow to a fan which in turn blows the snow in the direction desired. These conventional types of snow throwers are very large, very heavy and very expensive and difficult to operate and manipulate. In fact, these conventional two stage snow throwers are virtually impossible to be operated by old people, young people and those who are not very strong. Furthermore, these heavy two stage snowthrowers are difficult to store and because they are difficult to store normally must be kept in cold environments such as garages and the like which in sub-zero temperatures often makes them difficult to start.

Furthermore, in the majority of the snow belt, the snow does not fall in exceedingly large amounts, normally not in excess of 4 inches in depth. Where these lighter snowfalls are involved, these heavy duty two stage units can be an unnecessarily oversized unit and there is a need for a lighter easier to handle device for this lighter type of snowfall.

With the expansion of urban and suburban living, the majority of the homeowners do not have a great deal of surface to be cleaned of snow, the surface to be cleaned oftentimes only being some steps and a sidewalk or maybe a small driveway for the average homeowner. As previously mentioned, there are increasingly large numbers of people occupying townhouses and condominiums where they have a small area to be cleaned which might consist of a patio or a small sidewalk. People in these circumstances are reluctant to invest in these aforementioned heavy duty two stage snow throwers since, for the number of snowfalls involved in a season, the cost of the removal then becomes prohibitive. Furthermore, their size and difficult maneuverability make them impractical for these situations. Many of the areas where snow needs to be removed are of a nature where because of the difficulty of maneuverability of the heavy duty two stage units, the use of such a unit in these areas is either difficult or impossible depending on the circumstances.

Thus, there has long been a need for a lightweight snow remover which is easy to manipulate, inexpensive to buy, store, and which is capable of maneuvering in normally difficult areas which would be virtually inaccessible to a heavy duty two stage unit.

Furthermore, there are certain problems associated with gasoline engines, such as the usual hazards of having to store and use a combustible material such as gasoline, not to mention the inconvenience of periodically having to obtain gasoline and the various problems associated with cold weather, gas line freeze, etc. The problems of gasoline engines have further been accelerated recently by the shortages throughout the country and the world, placing distinct emphasis on the desirability of conserving energy.

In addition, most of the conventional and presently available snow removers have had the problem of lugging or torquing down as the load increases as the unit works through thicker, heavier or wetter snow, the resistance building to a point where the engine stops and stalls out, requiring restarting.

Therefore, the broad object of this invention is to solve all of the aforementioned problems. More specifically, one object of the invention is to provide a lightweight snow remover which is capable of being easily lifted, manipulated and operated by virtually everyone except extremely small infants. Another object is to provide a snow thrower which can be readily maneuvered in what would normally be inaccessable situations for larger two stage snow throwers and which can conveniently be used to clean off steps, stairways, etc.

Still another object is to provide a snow remover which is electrically powered to eliminate the problems associated with gasoline combustion engines.

An additional object is to provide a snow remover in which the performance characteristics of the motor will increase as the resistance increases to enable it to cope with varying situations which might be encountered in the course of a normal removal operation.

A further object is to provide a snow remover which is particularly effective for light snow falls, which can be conveniently stored indoors, and can even by hung on a wall, if desired.

Still another object is to provide a snow remover which is lighter and less expensive than any of the snow removers heretofore available capable of the same performance levels as the unit of the present invention.

Another object is to provide a snow thrower which can be selectively pushed straight ahead or swung from side-to-side to meet virtually every type of situation which the operator is likely to encounter.

Still another object is to provide an electrically powered snow thrower which has a uniquely designed cooling system for the motor which virtually elminates any chance of moisture or snow reaching the motor.

A further object is to provide an electrically powered snow thrower having a direct drive system between the motor and the rotor thereby maximizing efficiency and minimizing the number of parts required and the number of things which can potentially go wrong or malfunction.

These and other objects and advantages of the invention will more fully appear from the following description made in connection with the accompanying drawings, wherein like character references refer to the same parts throughout the several views, and in which.

Figure 4:
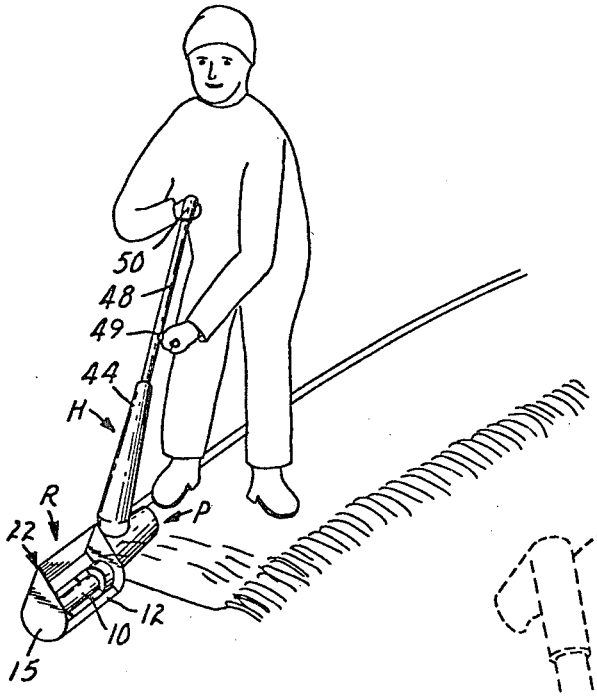
FIG. 4 is an illustrative view of the snow remover of FIGS. 1–3 in actual use with the operator using a side-to-side sweeping motion.

The unit disclosed comprises three basic parts, the rotor unit R, the power unit P and the handle unit H.

The rotor unit R includes an elongate hollow cylindrical rotor 10 which may be formed of any suitable lightweight material such as aluminum and on which is integrally formed pairs of diametrically opposed spaced apart blade holders 11 in which are mounted elongate snow removal paddles or blades 12 which are removably fastened thereto by fasteners 13. The paddles are preferably made of durable lightweight low friction plastic which endures repeated pounding on the surface and yet readily sheds the snow. The paddle holders may also be non-integral with the rotor, and be separate entities fastened to the rotor, such as a pair of opposed spaced apart angle brackets. The rotor is concentrically mounted for rotation on an elongate spindle or shaft 14, which spindle in turn is supported at its opposite ends by the sidewalls 15 and 16 of the upper housing. One end (the outer end) of the spindle 14 has a reduced threaded end portion 14*a* which extends through an opening in an end wall 15 and is fastened to said end wall by means of a nut 17. The same outer end of said spindle is rotatably supported in a bushing 18 preferably formed of bronze, the bushing 18 and the rotor 10 being connected by a supporting end piece 19 which is secured to both of them.

The other or inner end of the rotor 10 is rotatably supported on the spindle 14 by means of a ball bearing unit 20, which in turn is held in place by means of a shouldered circular annular boss or collar 21 forming an integral part of the rotor 10. This same inner end of the spindle is supported by the power unit P in a manner described in more detail hereinafter.

The rotor unit R also includes a back wall 22, the lower end 22*a* of which is curved and formed on the arc of a circle having as its radius the center of rotation of the rotor 10. The extreme lower end of the curved wall portion 22*a* is downwardly offset at 22*b* to back and support a scraper blade 23 which is generally triangular in cross-section. The scraper blade is designed to move along and against the surface to be cleaned to scrape and lift the snow and sometimes ice from the surface to be cleaned. The upper part 22*c* of the rear wall 22 is straight and tangential to the lower curved portion 22*a*, and is tilted or inclined so as to overlie the major portion of the rotation diameter of the paddle assembly, so as to direct the snow upwardly and outwardly away from the rotor unit R.

The rear wall 22 is preferably made of a low friction plastic material to prevent the snow sticking thereto, and to maximize the effective distance of throw of the snow.

Figure 3:
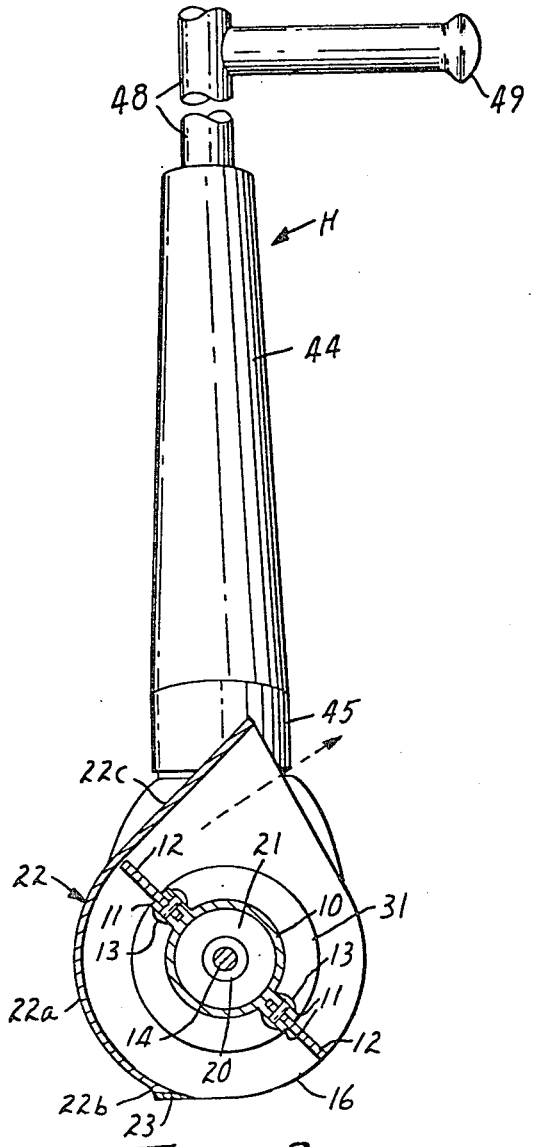
FIG. 3 is a cross sectional view taken along the lines 3—3 of FIG. 2.

The rotor 10 rotates in the direction of the broken line arrows seen in FIG. 3 with the paddles or blades 12 sweeping downwardly and rearwardly toward and against the scraper blade 23 picking up the snow collected on the scraper blade 23, and carrying it rearwardly against the lower rear wall 22*a* and then propelling it upwardly and outwardly along the wall portion 22*a* to the upper end 22*c* of the rear wall 22 to throw the snow high and far away from the area to be cleaned in the general direction of the broken arrow seen in FIG. 3.

Attention is next directed to the power unit P, which unit includes an an annular hollow housing 24 which provides a chamber which substantially completely encloses and houses an electric motor 25 which is preferably of the universal type. One end of the motor is supported on a shaft 26 which is rotatably supported on a bracket 27 in a bushing 28. The motor drives a drive shaft 29 which is provided with pinion drive teeth or gear 30 on the outer end thereof. Rotor 10 has integrally formed therewith an annular circular driven gear 31 which has internal gear teeth 32 formed thereon which teeth 32 mesh with gear 30 whereby the rotor 10 is rotatably driven by the electric motor 25. The drive shaft 29 is supported by a supporting bracket 33 which is carried by the housing 24. Drive shaft 29 is also supported by a bushing 34 which in turn is supported by a collar 35 attached to the end wall 16 of the rotor housing. The housing 24 has an internal vertical end wall 36 which supports the internal end of the rotor spindle 14. The housing 24 has an outer wall 37 which is provided with air holes 38 for passage of air through the interior of the housing 24 to keep the motor cool during operation. The upper side of the housing 24 is provided with an opening 39, which opening 39 is surrounded by an annular circular upstanding boss 40 on which the handle unit H is mounted, the boss 40 being formed integrally with the motor housing 24. The boss 40 has an inwardly offset ring or ledge 41 defining an opening 42 in the upper end of said boss 40, whereby cooling air for the motor is admitted through said boss and the upper opening 39 to the motor housing 24. The power unit housing 24 may also be supported by a skid member 43 if so desired.

The handle unit H includes an elongate tubular housing 44, the lower end of which terminates in a cylindrical portion 45 which is mounted on and rotatably encircles the upstanding boss 40 to enable the handle to rotate thereon and to be selectively adjustable relative to the rotor and power units for selective pushing or sweeping motion of the rotor housing. The handle housing 44 includes an inwardly extending circular ring or ledge 46 which is formed integrally therewith, said ring 46 resting and riding on ring 41 of boss 40 and defining an opening 47 for admitting cooling air for the motor into the boss 40 and motor housing 24.

The upper end of the handle unit H includes a rod 48 on which is mounted a lower handle grip 49 and an upper handle grip 50. Handle 50 houses a plug 51 connected to an electrical cord 52, which is connected with the electric motor 25 whereby by connection to a suitable outlet the electric motor can receive the electricity necessary to drive same.

A releasable latch or member 53 is slidably supported on one side of the handle housing 44 by member 54, said lock member having a manually operable handle 55 for selectively lifting the member to lock and unlock the handle. This enables the handle to be locked in any position desired. The lower end of the latch 53 seats in recesses 56 formed in the motor housing 24, and is disengaged or unlocked by lifting latch 53 out of seated engagement with the respective recess.

The upper underside of the handle housing 44 is provided with air inlet openings 57 for admitting cooling air to the interior of handle housing 44, whereupon the air travels downwardly through said handle housing and boss 40 into motor housing 24, it is ultimately discharged through openings 38 in the end after passing over and cooling the motor. The openings 57 are located in an area high enough and remote from the snow being thrown about so that no snow or water reaches the electric motor. The parts connected with the motor housing are in sealing relationship therewith so that the entire motor housing is protected from moisture. In order to limit the rotational movement of the handle unit so that it stops at the desired operational position, the boss 40 is provided with a circumferentially oriented slot in which rides a limit bolt 58, the ends of the slot against which the bolt 58 comes to rest defining the desired position of the handle.

Figure 1:
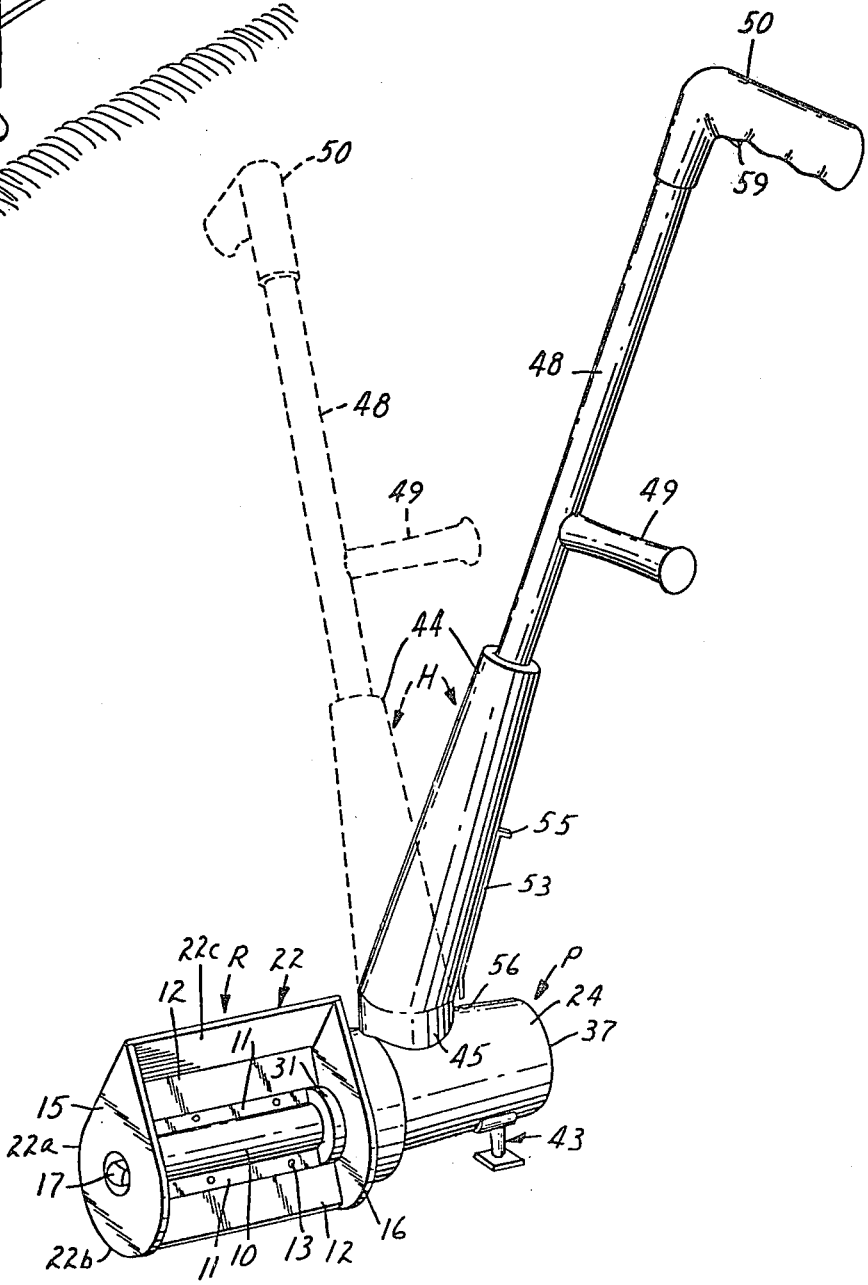
FIG. 1 is a perspective view of a snow remover constituting one preferred embodiment of this invention.
Figure 2:
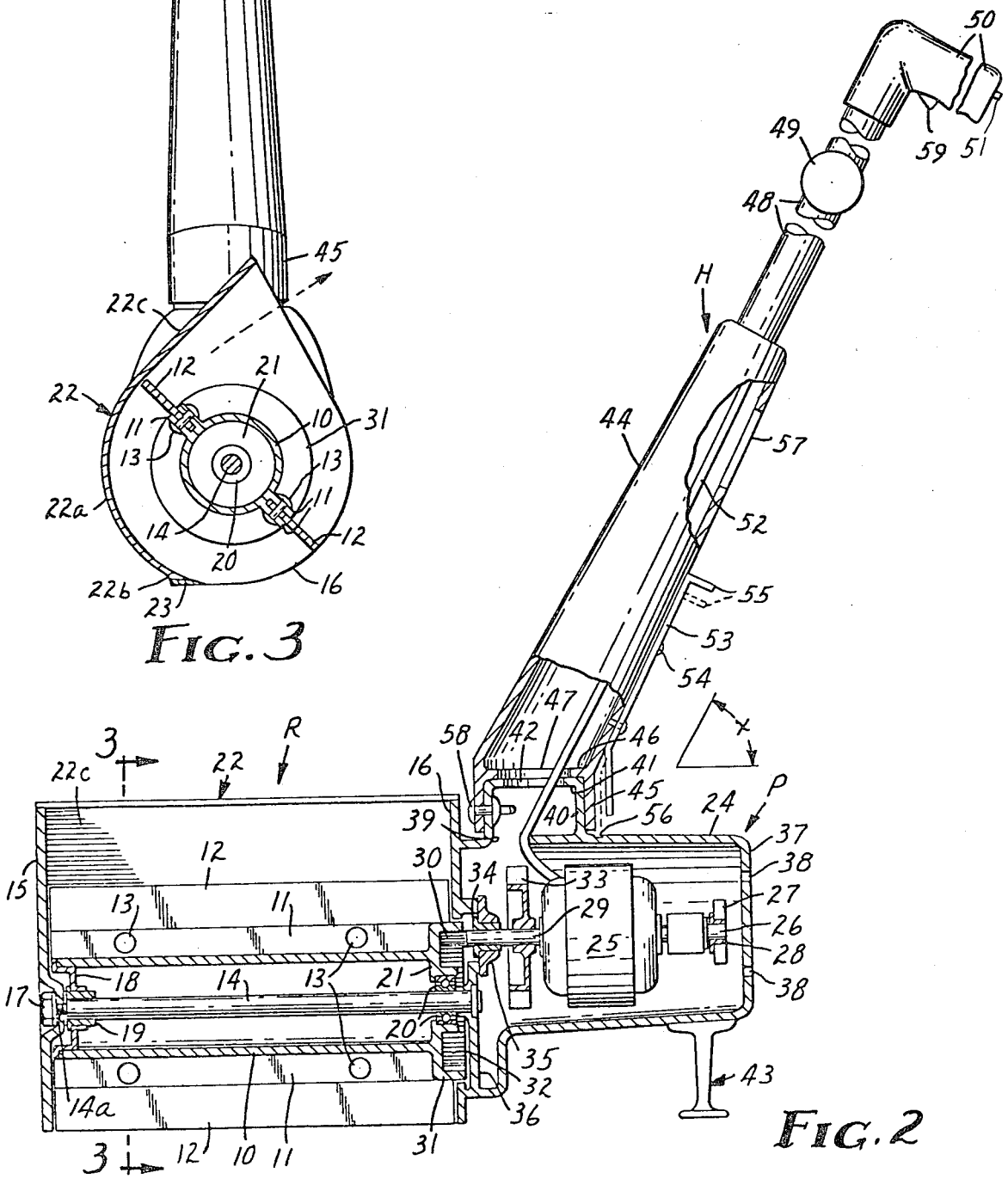
FIG. 2 is a front elevation view of the snow remover shown in FIG. 1, with portions broken away for clarity.
Figure 5:
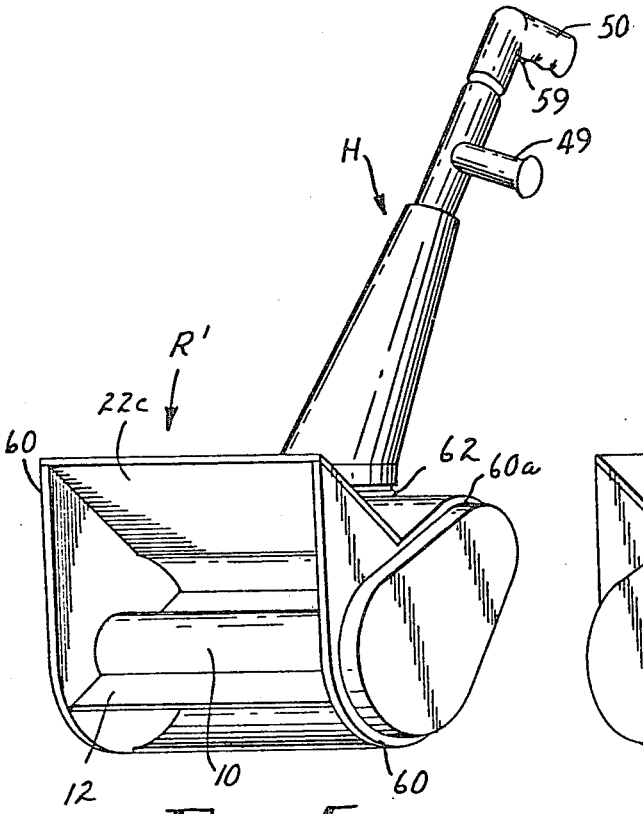
FIG. 5 is a left front perspective view of an alternate form of snow remover of this invention in which the motor is mounted behind the rotor.
Figure 6:
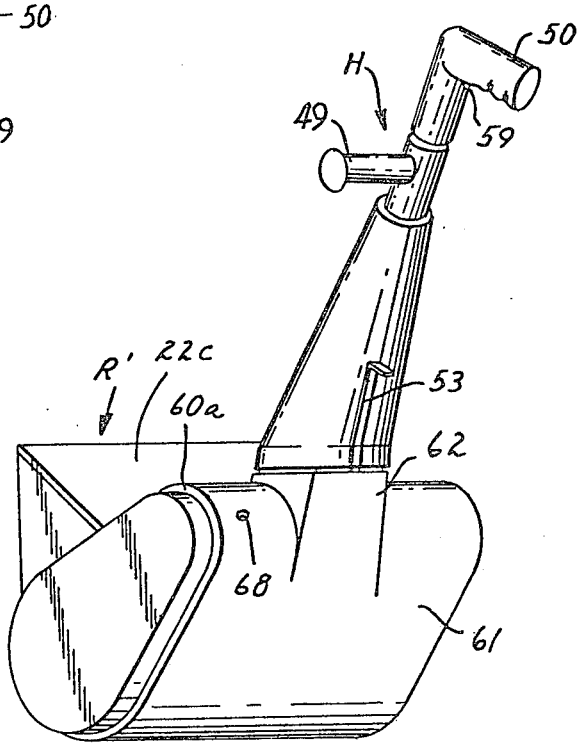
FIG. 6 is a left rear perspective view of the snow remover of FIG. 5.

In the view shown in FIG. 2, it will be noted that the handle is at an angle other than perpendicular with respect to the rotor housing and the motor. It is preferred that this angle X be between 30° and 75° with respect to the horizontal to provide the most effective use of this snow remover with an angle of approximately 60° being generally the most preferred angle for most applications. In the position shown in FIG. 2, the unit is designed to be swung back and forth in a sweeping motion by the operator in much the same manner as one would swing a broom when sweeping. If it is desired to push the unit rather than swing same, then the handle is moved 90° to the broken line position shown in FIG. 1, by rotating same relative to the power unit housing so that the handle extends rearwardly behind the rotor housing in a direction opposite to the direction in which the snow is thrown.

This dual positioning of the handles enables the snow remover to be used effectively in almost any situation. In the position shown in FIG. 2 and the solid line position of FIG. 1, the longitudinal axis of the handle lies in a plane which is parallel to the axis of rotation of the rotor, and in the version illustrated are substantially co-planar, with said plane of the handle being perpendicular to the direction of movement and throw of the rotor unit. This enables the snow to be thrown to the side of the operator and laterally with respect to the direction of movement of the operator.

In alternate broken line handle position of FIG. 1, the longitudinal axis of the handle lies in a plane which is perpendicular to the axis of rotation of the rotor, and parallel to the direction of movement and throw of the rotor housing and movement of the operator to faciliate pushing the unit through the snow ahead of the operator.

The handle grips 49 and 50 are disposed at right angles to each other to facilitate both the pushing and sweeping movement of the rotor unit. The lower handle 49 is adjustable to either side to facilitate use by both right and left handers.

An example of one successful snow remover made substantially similar to that illustrated in FIGS. 1 through 4 weighed approximately 9 pounds. The rotor had an effective circle of rotation of 6 inches in diameter and a length of 9 inches. The universal motor had a rating of 6 amps. The handle length was 42 inches, measured from the ground to outer tip, and it could throw the snow about 8 feet.

The discovery that a universal motor has an unexpectedly unique application in the snow thrower field solves many problems heretofore associated with powered snow removers. Every powered snow remover experiences peak demands and surges in the load requirements, resulting in lugging down of the rotor unit and stalling of the motor. However, the operating characteristics of a universal motor are such that it has a very high torque at low rpm, enabling it to continue to operate efficiently even during those peak periods when the heaviest, wettest and thickest snow is being plowed.

FIGS. 5 to 8 illustrate an alternate form of the invention in which the power source is mounted rearwardly or behind the rotor unit, rather than in endwise relationship therewith as in the previously described form of the invention illustrated in FIGS. 1 to 4.

The snowthrower of FIGS. 5 to 8 includes a rotor unit R′ which is essentially the same as rotor unit R, the rotor 10, the backwall 22, and blades on paddles 12 being the same. The side walls 60 are modified in design to include end wall portions **60*a*** to enclose the ends of the motor housing.

The same motor 25 can be used in this alternative form, and it is mounted behind and above the rotor 10 and rearwardly of back wall 22, with the axis of rotation of its armature shaft 26 being parallel to the axis of rotation of the rotor 10. The motor is housed within a second rear wall 61, the sides of which abut with the end of the rotor unit R′.

A handle support or boss 62 is integrally formed with the back wall 61, and functions in the same manner as boss 40 of the first described unit to support the same handle unit H for rotation about a vertical axis, with the interface between the handle unit and bars 62 providing a horizontal plane of pivot for the handle unit. It will be understood that in each of the illustrated and described versions, the handle angle remains the same with respect to the vertical and horizontal, regardless of which operative position it is turned to.

Figure 7:
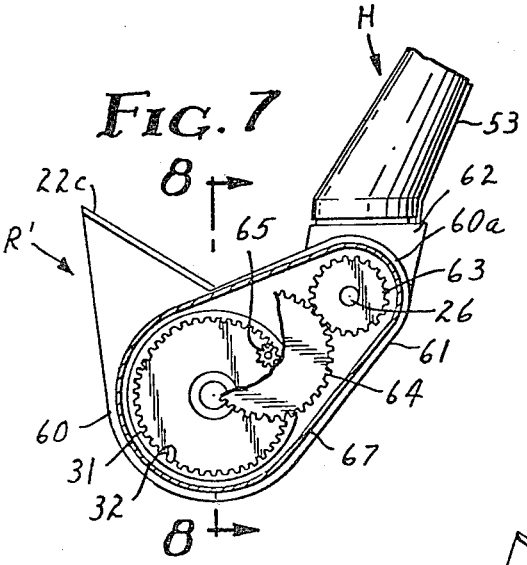
FIG. 7 is a side elevation view of FIGS. 5 and 6, with portions broken away.
Figure 8:
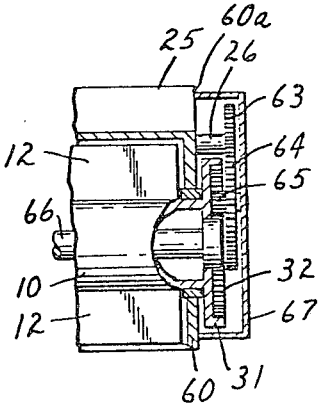
FIG. 8 is a cross-sectional view taken along the line 8—8 of FIG. 7.

Because of the change in the relative positions of the motor and rotor, transmission means must be provided between them, and this transmission means is best seen in FIGS. 7 and 8. The transmission means includes a drive pinion 63 mounted on and driven by the motor armature shaft 26. The pinion 63 in turn is in driving engagement with a larger intermediate gear 64 which in turn concentrically supports and drives another pinion gear 65, which in turn is drivingly engaged with the internal gear 31 which is drivingly connected to the rotor 10. Gears 64 and 65 are supported by a spindle 66 which in turn is supported by a gear cover 67 which in turn is supported by side walls 60 and **60*a*** in any suitable manner.

This alternate design still provides all the advantages of the earlier described design of FIG. 1, including the ability to utilize a sweeping action to either side of the direction of travel, or to throw it straight ahead by simply adjusting the handle relative to the rotor housing. The motor is also elevated from ground level, thereby reducing the chances of being exposed to moisture such as snow or water. The back wall 61 of the motor housing is provided with openings 68 to permit exhausting air from the motor housings, and they function in the same manner as the air holes 38 of FIG. 1, thereby permitting cooling air to be drawn through the handle unit and across the motor to keep the motor cool during operation.

It is to be understood that in the alternate form of FIGS. 5 through 8 inclusive, the handle unit H is identical in construction to the handle unit of FIGS. 1 through 4 with one minor modification and is noted hereafter coupled to the supporting power unit in the same manner. Since the details of construction are the same, another detailed sectional view is deemed unnecessary.

Thus, the handle unit of FIGS. 5 through 8 has an upstanding cylindrical boss corresponding to boss 62 of its power unit, and a depending cylindrical portion, skirt or flange corresponding to the cylindrical portion 45 of FIG. 2 which cooperates or mates with the upstanding boss 40, to not only connect the handle unit to the power unit but also to provide a pivot connection to enable the handle unit H to pivot about a vertical axis defined by the vertical center lines of members 40 and 45 between various operative positions. The minor modification referred to above is in the length of the guide slot in boss 40 in which the limiting bolt 58 rides. In FIGS. 5 through 8 the slot is longer to enable the handle to swing through 180 degrees of movement, rather than the 90 degrees of movement of FIGS. 1 through 4. This enables the operators to adjust the handle so that the rotor unit R' faces either to his left or his right, as desired for swinging, sweeping movement, as well as directly ahead (as in FIGS. 5 and 6) for pushing movement. Thus, the handle can be swung 90 degrees to the right or the left of the handle position shown in FIGS. 5 and 6.

In each of the handle units of this invention, it is preferred that the depending member 45 be the female or outside portion of the connection, and that the upstanding member 40 be the male or inside portion of the connection, to prevent liquid from entering the motor housing through the pivot connection. It can be readily seen that in this design shown, the skirt 45 sheds water and prevents it from getting into boss 40 and the motor housing.

Figure 9:
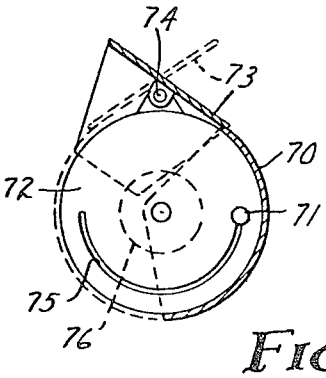
FIG. 9 is an illustrative side view of still another alternate form of this invention.

Still another form of the invention is shown somewhat illustratively in FIG. 9, in which the rotor housing is designed to be flipped from side to side to facilitate changing the direction of the throw.

In this version, the back wall 70 of the rotor housing slidably supported at each end by the end walls 72 of the rotor housing. Each end wall 72 is provided with a semi-circular slot 75 in which rides a pin 71 connected with the back wall 70 in any suitable manner, the pins 71 being provided with a fastener such as a wing nut (not shown) to lock it in place. Thus, by loosening the fasteners, the back wall 70 can be slid from the solid line position of FIG. 9 to the diametrically opposite broken line position of FIG. 9 in which it faces in the opposite direction. To prevent premature dispersal of the snow and control the angle of throw of the snow, an extension plate or wall member 73 is provided, which is held by a pivot pin 74 so that it can be tiltably adjusted from the solid line position of FIG. 9 in which it would direct the snow to the left(as viewed in FIG. 9) to the broken line position of FIG. 9, in which it would direct the snow to the right (as viewed in FIG. 9). The top 73 of the housing is, in effect, a two-way plate, capable of mating with either end of the backwall 70 regardless of which direction the rotor housing is facing. In this version, the motor 76 is a reversing motor which can selectively rotate in either direction to adjust to the direction of throw desired.

Figure 10:
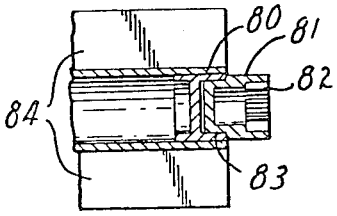
FIG. 10 is a partial sectional view of still another alternate form of this invention.

FIG. 10 illustrates still another form of the invention, involving a snow remover with clutch means for operating by disconnecting the rotor from the drive system in the event it gets overloaded by snow or gets an object stuck between the rotor blades and the housing which inhibits movement.

In FIG. 10, a portion of a rotor unit is shown which includes a cylindrical rotor 80 on which are mounted the snow collecting and throwing paddles or blades 84. A cylindrical driven hub 81 is cooperatively installed in one end of the rotor 80 with an interference fit or a tight slip fit between the rotor 80 and the hub 81 to provide a clutching surface 83 therebetween. The hub 81 is also provided with internal gear teeth 82 to be driven by the drive pinion 30 on the motor shaft in the manner hereinbefore described. Under normal circumstances, the power will be transmitted from the pinion 30 to the hub 81 through the clutching surface 83 at the circular interface between the hub 81 and the rotor 80, thereby turning the rotor and the blades 84 carried thereon. However, if the blades encountered too much snow for the motor to handle, or if some foreign object such as a stone or stick gets stuck between the blades and the housing, the hub 81 will slip relative to the rotor 80, thereby preventing stalling of the engine and possible damage thereto or to the drive system components until the overloading is corrected or the foreign object is removed.

If the clutch of FIG. 10 is not used, one preferred version of the invention, such as that illustrated in FIG. 2, involves having the internal gear 31 and its teeth 32 molded integrally with the rotor 10 as a single integral member, thus simplifying manufacture and minimizing cost.

The clutch form of the invention shown in FIG. 10 also facilitates another inventive concept of this invention, namely the concept of preassembling the rotor and blade assembly to at least the outer end wall and back wall of the rotor housing, which preassembled unit would then be joined to the motor housing at some later point in the overall assembly process. In such a situation, the rotor 80 with its blades 84 would be preassembled with an outer end wall corresponding to 22. A motor housing corresponding to 24, with a motor corresponding to 25, a shaft corresponding to 29, a pinion corresponding to 30, and a hub corresponding to 81 with internal teeth 82 can be preassembled as a unit and then fastened or otherwise connected to the aforedescribed rotor, blade, and rotor housing preassembly unit in any suitable manner.

The supporting structure of FIG. 2 also is adaptable to this preassembly procedure. In this version, the rotor assembly including the rotor 10 with its integrally molded internal gear 31 and its teeth 32 and the blades 12 mounted thereon, and its spindle 14 and bearings 20 would be preassembled with the outer end wall 15 and back wall 22. Another preassembled unit of FIG. 2 would be the motor housing 24 with its motor 25, shaft 29, and pinion 30, and collar 34, and inner wall portions 36 and 16. This second preassembled unit would then be assembled with the first mentioned preassembled unit involving the rotor by securing the wall structure of the motor housing to the back wall 22 by suitable fastening means, installing the inner end of the spindle 14 in the opening provided in wall portion 36, and placing the pinion 30 in driving engagement with internal teeth 32.

It is also desirable to form the internal gear 31 and its teeth from plastic material as an insulation factor, thereby providing a double insulated unit.

It will also be understood that the handle unit can be designed so as to be locked in a variety or multiplicity of positions other than the positions illustrated and/or described within the scope hereof.

Other advantages of the snow remover of this invention include the fact that it is non-polluting, and less costly to operate than a gas driven unit in those areas where the cost of gas has become excessive. The snow remover is useful in shaving high drifts as much as four to six feet high such as those that develop along fences and is also useful in shaving snow off along the edges of the roof on a house. The snow remover is quieter and easier to start than gasoline models, and is healthier than currently available snow removers because of its easy starting and the light weight which minimizes strain and potential heart attacks and back problems.

In operation, the handle unit is positioned relative to the rotor unit, and locked in place by manipulation of the latch 53. If a long narrow sidewalk is to be cleared, the handle unit H and rotor unit R will be positioned as in FIGS. 1 and 4, the cord will be plugged into a source of electricity, and the operator will grip the handle grip 49 with one hand and the handle grip 50 with the other hand, and begin to clear the walk with a swinging or sweeping movement such as that illustrated in FIG. 4. In wider areas such as driveways, it may be better to push, rather than swing, in which case the handle is adjusted to the broken line position of FIG. 1. In the pushing style, the snow is thrown ahead of the operator in the direction of travel. In the swinging or sweeping style, the snow is thrown to the right or left of the operator at right angles to the general direction of travel of the operator. Regardless of style of operation, the snow is gathered by the paddles 12 and thrown rearwardly and upwardly against the back wall 22 and directed away from the remover and operator by the upper inclined wall portion 22*c*. The scraper blade rides along the surface to be cleaned, directing snow upwardly along the rear wall, and scraping loose compacted snow and ice from the surface to be cleaned. The lower handle grip 49 may be designed so as to swing through 180° of movement on its supporting rod and locked in either the position illustrated or in a diametrically opposite position to facilitate use by either right or left handed people. It will of course be understood that various changes may be made in form, details, arrangements, and proportions of the various parts without departing from the scope of this invention.

I claim:

1. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and wherein said housing means includes a pair of end walls disposed parallel to the direction of travel and an upper housing portion extending between said end walls, said upper housing portion including a motor enclosing portion disposed between said end walls and upwardly and rearwardly from said wall means, said handle means extending upwardly and rearwardly from said upper housing portion, and wherein said handle means includes single continuous elongate tubular handle means whose longitudinal axis is perpendicular to the axis of rotation of said gathering means, and tapered housing means extending between said upper housing portion and the lower end portion of said tubular handle means.

2. The snow thrower of claim 1, wherein said tapered housing means extends generally upwardly and rearwardly from said housing means, said taper being such that the upper portion of said tapered housing means is smaller than the lower portion thereof.

3. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and wherein said housing means includes a pair of end walls disposed parallel to the direction of travel and an upper housing portion extending between said end walls, said upper housing portion including a motor enclosing portion disposed between said end walls and upwardly and rearwardly from said wall means, said handle means extending upwardly and rearwardly from said upper housing portion, and wherein said upper housing portion tapers upwardly when viewed from the side, the upper portion being smaller than the lower portion thereof.

4. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and including means for transmission of power from said motor means to said gathering means, said transmission means including first and second clutching surfaces each lying in planes parallel to said axis of rotation, and wherein said gathering means includes a cylinder rotatable about its longitudinal axis, said cylinder having an inner wall surface comprising said first clutching surface, said transmission means including a gear member having an annular surface insertable in said cylinder in opposing relationship to said inner wall surface and providing said second clutching surface.

5. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and wherein said housing means includes a pair of end walls disposed parallel to the direction of travel and an upper housing portion extending between said end walls, said upper housing portion including a motor enclosing portion disposed between said end walls and upwardly and rearwardly from said wall means, said handle means extending upwardly and rearwardly from said upper housing portion, wherein said handle means comprises a single continuous tubular elongate handle means, wherein said first grip means is a pistol type grip, wherein said upper housing portion of said housing has an opening formed therein for exhausting air after it has cooled said electric motor, wherein the drive shaft of said motor rotates about an axis which parallels the axis of rotation of said snow gathering means, including transmission means extending between said motor shaft and said snow gathering means for driving said snow gathering means, said transmission means being substantially completely enclosed by a transmission housing, said transmission housing including one of said end walls and a second wall parallel to and spaced from said one end wall for enclosing said transmission means therebetween, said handle means extending upwardly and rearwardly with respect to said housing means from substantially midway between the lateral limitations of said housing, and secondary housing means extending between said upper housing portion and the lower end portion of said tubular handle means.

6. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and wherein said handle means comprises an elongate tubular handle means extending upwardly and rearwardly with respect to said housing means from substantially midway between the lateral limitations of said housing, second housing means disposed behind said wall means and extending upwardly and rearwardly therefrom, said electric motor being enclosed by said second housing means, the lower end portion of said tubular handle means being in communication with the interior of said second housing means for delivering cooling air to said electric motor, a first opening in said secondary housing means for exhausting air from said secondary housing after it has passed over said electric motor, and a second opening in said tubular handle means for admitting air thereto from a location remote from said secondary housing, said tubular handle means being adapted to convey cooling air from said second opening to the interior of said second housing means for cooling said electric motor.

7. The snow thrower of claim 6, wherein the drive shaft of said motor rotates about an axis which parallels the axis of rotation of said snow gathering means.

8. The snow thrower of claim 6, including supporting structure for said handle means, said supporting structure extending upwardly and rearwardly from said second housing means and supported thereby, said supporting structure being substantially narrower in width than said secondary housing and wider than the major portion of said tubular handle means, said supporting structure engaging and supporting the lower end portion of said handle means.

9. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and including secondary housing means disposed behind said wall means and extending upwardly and rearwardly therefrom, said secondary housing means including an upwardly and rearwardly inclined front wall, an upwardly and rearwardly inclined rear wall, and upwardly and rearwardly inclined end walls in opposed, spaced apart relationship and defining the lateral limits of said snow thrower, and wherein said front wall and rear wall are in opposed spaced apart relationship to accomodate said electric motor therebetween, said front and rear walls tapering towards one another as they extend upwardly whereby they are closer together at their upper end portions than they are at their lower end portions, said front and rear walls being connected at their upper ends by an upper wall extending therebetween and connecting said end walls.

10. The snow thrower of claim 9, wherein said upper wall is generally convexly curved in cross section.

11. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and including secondary housing means disposed behind said wall means and extending upwardly and rearwardly therefrom, said secondary housing means including air upwardly and rearwardly inclined front wall, an upwardly and rearwardly inclined rear wall, and upwardly and rearwardly inclined end walls in opposed, spaced apart relationship and defining the lateral limits of said snow thrower, and wherein said electric motor is enclosed within said secondary housing means, and including supporting structure for said handle means, said supporting structure extending upwardly and rearwardly from said second housing means and supported thereby, said supporting structure being substantially narrower in width than said secondary housing and wider than the major portion of said tubular handle means, said supporting structure engaging and supporting the lower end portion of said handle means.

12. A powered snow thrower comprising forwardly open housing means, snow gathering means rotatable about a horizontal axis perpendicular to the direction of travel, said gathering means being adapted to throw the gathered snow rearwardly, wall means forming a part of said housing means and adapted to receive said rearwardly thrown snow and direct same upwardly and forwardly over and beyond said gathering means, an electric motor supported by said housing means and drivingly engaged with said gathering means for rotating same, elongate handle means extending upwardly and rearwardly from said housing means, the longitudinal axis thereof being disposed perpendicular to said axis and parallel to the normal direction of travel of said snow thrower, first grip means at the upper end portion of said handle means, second grip means carried by said handle means and located between said first grip means and said housing means, said grip means being adapted to be gripped by the hands of the operator for manipulating said snow thrower, said handle means being tubular, electric cord means disposed in said handle means and extending between said first grip means and said electric motor, switch means located adjacent said first grip means and adapted to be operated by the fingers of the operator and which holds said first grip means, and plug means cooperatively attached to said cord and switch means for connecting same to a source of electric power, and including means for transmission of power from said motor means to said gathering means, said gathering means including a rotor rotatable about said horizontal axis and having snow gathering paddles mounted thereon, said rotor having an interior cylindrical portion coaxial with said horizontal axis and providing cylindrical wall surface which parallels said axis and provide a first clutching surface, and including transmission means for transmitting of power from said motor means to said gathering means, said transmission means including a cylindrical hub concentrically installed in said cylindrical portion of said rotor and coaxial therewith, said hub having an exterior cylindrical wall surface providing a second clutching surface which faces and engages said first clutching surface in slip fitting relationship therebetween, said hub and rotor being substantially immovable relative to each other in an axial direction, said second clutching surface being adapted to engage said first clutching surface and drive said rotor thereby, said clutching surfaces being adapted to slip relative to one another about said axis when the load on said paddles reaches a predetermined amount to prevent stalling of the engine or damage to the drive system when the snow thrower becomes overlooked.

* * * * *